United States Patent [19]

Dickakian

[11] Patent Number: 4,502,943

[45] Date of Patent: Mar. 5, 1985

[54] POST-TREATMENT OF SPINNABLE PRECURSORS FROM PETROLEUM PITCH

[75] Inventor: Ghazi Dickakian, Greenville, S.C.

[73] Assignee: E. I. Du Pont de Nemours and Company, Wilmington, Del.

[21] Appl. No.: 479,177

[22] Filed: Mar. 28, 1983

[51] Int. Cl.[3] ..... C10C 1/20; C10C 1/18; C10C 3/08

[52] U.S. Cl. ..... 208/44; 208/40; 208/39; 208/45; 208/22

[58] Field of Search ..... 208/44, 40, 39, 22, 208/45; 423/447.1, 447.2, 447.4, 447.8

[56] References Cited

U.S. PATENT DOCUMENTS

| | | | |
|---|---|---|---|
| 3,919,376 | 11/1975 | Schulz | 423/447.4 |
| 4,032,430 | 6/1977 | Lewis | 208/39 |
| 4,184,942 | 1/1980 | Angier et al. | 423/447.1 |
| 4,208,267 | 6/1980 | Diefendorf et al. | 208/45 |
| 4,219,404 | 8/1980 | Dickakian | 208/22 |
| 4,271,006 | 6/1981 | Dickakian | 208/45 |
| 4,301,135 | 11/1981 | Nazem et al. | 423/447.6 |
| 4,317,809 | 3/1982 | Lewis et al. | 423/447.2 |
| 4,402,928 | 9/1983 | Lewis et al. | 423/447.1 |

FOREIGN PATENT DOCUMENTS

| | | | |
|---|---|---|---|
| 66477 | 12/1982 | European Pat. Off. | 208/22 |
| 2829288 | 1/1979 | Fed. Rep. of Germany | 208/45 |
| 7304398 | 10/1973 | Netherlands | 423/447.1 |

*Primary Examiner*—Delbert E. Gantz
*Assistant Examiner*—Helane M. Myers

[57] ABSTRACT

A spinnable precursor from petroleum pitch is obtained by subjecting a distillable oil removed carbonaceous residue of petroleum origin to solvent extraction and thereafter heat treating the extracted solvent insoluble fraction under reduced pressure.

12 Claims, No Drawings

POST-TREATMENT OF SPINNABLE PRECURSORS FROM PETROLEUM PITCH

BACKGROUND OF THE INVENTION

The present invention is generally concerned with the preparation of a feedstock for carbon artifact manufacture from carbonaceous residues of petroleum origin including distilled or cracked residium of crude oil and hydrodesulfurized residues of distilled or cracked crude oil and to the use of that feedstock for carbon artifact manufacture, including fiber preparation.

Carbon artifacts have been made by pyrolyzing a wide variety of organic materials. It should be appreciated that this invention has applicability to carbon artifact formation generally and most particularly to the production of shaped carbon articles in the form of filaments, yarns, films, ribbons, sheets and the like.

The use of carbon fibers in reinforcing plastic and metal matrices has gained considerable commercial acceptance where the exceptional properties of the reinforcing composite materials such as their higher strength to weight ratio clearly offset the generally high costs associated with preparing them. It is generaly accepted that large-scale use of carbon fibers as a reinforcing material would gain even greater acceptance in the marketplace, if the costs associated with the formation of the fibers could be substantially reduced. Thus, the formation of carbon fibers from relatively inexpensive carbonaceous pitches has received considerable attention in recent years.

Many carbonaceous pitches are known to be converted at the early stages of carbonization to a structurally ordered optically anisotropic spherical liquid called mesophase. The presence of this ordered structure prior to carbonization is considered to be significant in determining the fundamental properties of any carbon artifact made from such a carbonaceous pitch. Indeed, the ability to generate high optical anisotropicity during the early processing steps is accepted particularly in carbon fiber production as a prerequisite to the formation of high quality products. Therefore, one of the first requirements of any feedstock material suitable for carbon artifact manufacture and particularly carbon fiber production is its ability to be converted to a highly optically anisotropic material.

In addition to being able to develop a highly ordered structure, suitable feedstocks for carbon artifact manufacture and particularly carbon fiber manufacture should have relatively low softening points, rendering them suitable to being deformed, shaped or spun into desirable articles. For carbon fiber manufacture, a suitable pitch which is capable of generating the requisite highly ordered structure must also exhibit sufficient viscosity for spinning. Unfortunately, many carbonaceous pitches have relatively high softening points. Indeed, incipient coking frequently occurs in such materials at temperatures where they have sufficient viscosity for spinning. The presence of coke or other infusable materials and/or undesirably high softening point components generated prior to or at the spinning temperatures are detrimental to processability and are believed to be detrimental to product quality. For example, U.S. Pat. No. 3,919,376 discloses the difficulty in deforming pitches which undergo coking and/or polymerization near their softening temperatures.

Another important characteristic of a feedstock for carbon artifact manufacture is its rate of conversion to a suitable optically anisotropic material. For example, in the above-mentioned U.S. patent, it is disclosed that 350° C. is the minimum temperature generally required to produce mesophase from a carbonaceous pitch. More importantly, however, is the fact that at least one week of heating is necessary to produce a mesophase content of about 40% at that minimum temperature. Mesophase, of course, can be generated in shorter times by heating at higher temperatures. However, as indicated above, at temperatures particularly in excess of about 425° C., incipient coking and other undesirable side reactions do take place which can be detrimental to the ultimate product quality.

It has become known that typical graphitizable carbonaceous pitches contain a separable fraction which possesses very important physical and chemical properties insofar as carbon fiber processing is concerned. Indeed, the separable fraction of typical graphitizable carbonaceous pitches exhibits a softening range or viscosity suitable for spinning and has the ability to be converted at temperatures in the range generally of about 230° C. to about 400° C. to an optically anisotropic deformable pitch. Unfortunately, the amount of separable fraction present in well known commercially available graphitizable pitches such as Ashland 240 and Ashland 260, to mention a few, is exceedingly low. For example, with Ashland 240, no more than about 10% of the pitch constitutes a separable fraction capable of being thermally converted to a liquid crystalline phase.

It has also become known that the amount of the fraction of typical graphitizable carbonaceous pitches which exhibits a softening point and viscosity suitable for spinning and has the ability to be rapidly converted to low temperatues to highly optically anisotropic deformable pitch can be increased by heat soaking the pitch, for example at temperatures in the range of 350° C. to 450° C., until spherules visible under polarized light begin to appear in the pitch. The heat soaking of such pitches has generally resutled in an increase in the amount of the fraction of the pitch capable of being converted to an optically anisotropic phase. Indeed, yields up to about 48% of a separable phase were obtained upon heat treatment of the Ashland 240, for example.

It is disclosed in U.S. Pat. No. 4,219,404 that polycondensed aromatic oils present in isotropic carbonaceous feedstocks are generally detrimental to the rate of formation of highly optical anisotropic material in such feedstocks when heated at elevated temperatures and such polycondensed aromatic oils can be readily removed by techniques such as vacuum or steam stripping or the like. Heat soaking such pitches in which at least a portion of the amount of aromatic oils have been removed results in high yields of a feedstock suitable for carbon artifact manufacture. The patent further discloses that such a pitch can thereafter be treated with a solvent or mixture of solvents which will result in the separation of the solvent insoluble fraction of the pitch which is highly anisotropic or capable of being converted to a highly anisotropic phase and which has a softening point and viscosity at temperatures in the range of about 250° C. to about 400° C. which is suitable for spinning.

Copending Application Ser. No. 475,068, filed Mar. 14, 1983 (PCO-33-82), similarly assigned, teaches that there is a particular fraction of the distillable oil removed carbonaceous residue of petroleum origin of the aforementioned patent, U.S. Pat. No. 4,219,404, which can be recovered by suitable means and converted into a precursor feed stock material that exhibits a softening point and viscosity which is suitable for spinning and has the ability to be rapidly converted at low temperatures to highly optical anisotropic deformable pitch. That fraction exhibits a reversed solubility curve and is obtained by subjecting the heat-soaked, distillation oil removed carbonaceous residue to a two-stage extraction in an organic solvent to take advantage of the reverse solubility curve followed by heat-soaking at atmospheric pressure.

It has now been discovered that the distillation oil removed carbonaceous residue of petroleum origin whcih has been solvent extracted as described in the aforementioned U.S. Pat. No. 4,219,404, or in my copending application can be further improved by an additional heat treatment step at reduced pressure to provide a precursor feed stock material that exhibits a softening point and viscosity which is suitable for spinning and has the ability to be rapidly converted at low temperatures to highly optical anisotropic deformable pitch.

It is, accordingly, the object of this invention to provide a method of obtaining a pitch having a softening point and viscosity suitable for spinning and to provide spun products from such a pitch. This and other objects of the invention will become apparent to thsoe skilled in the art from the following detailed description of the invention.

SUMMARY OF THE INVENTION

This invention relates to the preparation of a feedstock for carbon artifact manufacture and to the feedstock and the spun products therefrom. A distillable oil removed carbonaceous residue of petroleum origin is subjected to extraction with an organic solvent system and thereafter the precipitated organic solvent insoluble fraction is heat treated under reduced pressure. The resulting heat treated fraction can be spun into carbon fibers.

DESCRIPTION OF THE INVENTION

As used herein, the term "pitch" means highly aromatic petroleum pitches and pitches obtained as by-products in the gas oil or naphtha cracking industry, pitches of high carbon content obtained from petroleum cracking and other substances having properties of aromatic pitches produced as by-products in various industrial chemical processes. "Petroleum pitch" refers to the residuum carbonaceous material obtained from the thermal, steam and catalytic cracking of petroleum distillates including hydrodesulfurized residuum of distilled and cracked crude oils.

Pitches generally having a high degree of aromaticity are suitable for carrying out the present invention. High boiling, highly aromatic streams containing such pitches or that are capable of being converted into such pitches are also employable. One example of such streams are catalytic cracker bottoms. Additionally, various commercially available pitches having high aromaticity and high carbon content which are known to form mesophase in substantial amounts during heat treatment at elevated temperatures can also be used. Examples of the latter include Ashland 240 and Ashland 260. Typical characteristics of an atmospheric pressure heat soaked commercial pitch (Asland 240) and two vacuum heat soaked cat cracker bottom pitches are set forth in Table I:

TABLE I

| | Ashland 240 Pitch | CCB-Pitch (I) | CCB-Pitch (II) |
|---|---|---|---|
| Soft Point (°C.) | 100 | 115 | 140 |
| Toluene Insolubles % (TiSEP Method) | 10.0 | 10.3 | 29.0 |
| Toluene Insolubles % (Reflux Method) | 7.0 | 6.0 | 22 |
| Quinoline Insolubles (ASTM @ 75° C.) | 0.1 | 0.1 | 1.7 |
| Ash (%) | 0.100 | 0.100 | 0.100 |
| Glass Transition Temperature of Toluene Insolubles (°C.) | 281 | 274–294 | 273 |
| Distillate Oil Content (%) | 39.0 | 31.0 | 26.0 |
| Carbon (%) | 89.96 | 91.63 | — |
| Hydrogen (%) | 5.40 | 5.37 | — |
| C/H Atomic Ratio | 1.39 | 1.42 | 1.65 |
| Aromatic Carbon (Atom %) | 84 | 78 | 84 |
| Aliphatic Protons (%) | 5 | 12 | 5 |
| Benzylic Protons (%) | 37 | 35 | 37 |
| Aromatic Protons (%) | 57 | 50 | 57 |

The foregoing pitches contain an aromatic oil which is detrimental to the rate of formation of the highly optical anisotropic phase when such pitches are heated at elevated temperatures. In accordance with the aforementioned U.S. Pat. No. 4,219,404, the oil is removed and the pitch is heat soaked to obtain the pitch which is subjected to an extraction process. In general, the pitch is treated so as to remove greater than 40%, and especially from about 40 to about 90% of the total amount of the distillable oil present in the pitch although in some instances it might be desirable to remove substantially all of the oil in the pitch. Preferably, about 65–80% of the oil in the pitch is removed.

One technique which can be used is to treat the isotropic carbonaceous pitch under reduced pressure and at temperatures below the cracking temperature of the pitch. For example, the pitch can be heated to a temperature of about 250°–380° C. while applying vacuum to the pitch of about 0.1–25 mm Hg pressure. After an appropriate proportion of the oil has been removed, the pitch is cooled and collected.

The heat-soaked, distillable oil removed pitch is next subjected to extraction with a solvent, or a mixture of solvents, which will result in the separation of a solvent insoluble fraction of the pitch which is highly anisotropic or capable of being converted into a highly anisotropic phase which is suitable for spinning. The extraction process can be carried out as described in the aforementioned patent, U.S. Pat. No. 4,219,404 or the U.S. application Ser. No. 903,171, filed May 5, 1978 referred to therein, both of which are incorporated herein by reference. As disclosed therein, the extraction can be carried out simultaneously or subsequently to the heat-soaking operation. The organic solvent system employed can be a single solvent or a combination of solvents. Typically such solvent, or mixture of solvents, includes aromatic hydrocarbons such as benzene, toluene, xylene, tetrahydrofuran, chlorobenzene, trichlorobenzene, dioxane, tetramethylurea, and the like, and mixtures of such aromatic solvents with aliphatic hydrocarbons such as toluene/heptaine mixtures. The solvent system has a solubility parameter of about 8–9.5 or higher and preferably about 8.7–9.2 at 25° C. The solubility parameter of a solvent or a mixture of solvents is equal to $(H_v - RT/V)^{\frac{1}{2}}$ in which $H_v$ is the heat of vaporization of the material, R is the molar gas constant, T is the temperature of °K. and V is the molar volume. For a further description of the solubility parameter, reference may be had to Hildebrand, et al, "Solubility of Non-Electrolytes", 3rd Ed, Reinhold Publishing Co., N.Y. (1949) and "Regular Solutions", Prentice Hall, N.J. (1962). The solubility parameters at 25° C. for hydrocarbons in commercial $C_6$–$C_8$ solvents are: benzene, 8.2; toluene, 8.9; xylene, 8.8; n-hexame, 7.3; n-heptane, 7.4; methylcyclohexane, 7.8; bis-cyclohexane, 8.2. Among the foregoing solvents, toluene is preferred. As is well known, solvent mixtures can be prepared to provide a solvent system with the desired solubility parameter. Among mixed solvent systems, a mixture of toluene and heptane is preferred having greater than about 60 volume percent toluene, such as, e.g., 60% toluene/40% heptane and 85% toluene/15% heptane.

The amount of solvent employed will be sufficient to provide a solvent insoluble fraction which is capable of being thermally converted to greater than 75% of an optically anisotropic material in less than 10 minutes. Typically, the ratio of solvent to pitch will be in the range of from about 5 ml to about 150 ml of solvent to gram of pitch. The extraction process can be carried out at any convenient temperature and is preferably carried out at reflux.

Alternatively, the extraction process can be effected as described in the above-identified copending application. This extraction process uses the same organic solvent system but carries out the extraction in two phases. In the first phase, the distillable oil removed pitch is contacted with a quantity of the organic solvent system in which it is soluble. For example, the pitch to solvent weight ratio can vary from about 0.5:1 to about 1:0.5. The solubilization can be effected at any convenient temperature although refluxing is preferred. A portion of the heat-soaked, distillable oil removed pitch is insoluble in the organic solvent system under these conditions and can easily be separated therefrom, for example, by filtration. This insoluble portion represents inorganic impurities and high molecular weight coke-like material. In order to recover the desired fraction which is now solubilized, the quantity of the organic solvent system is increased to an amount sufficient to precipitate the desired fraction. As a general rule, the pitch to solvent ratio is increased to about 1:2 to 1:16. The temperature at which the second phase of the extraction process is effected can be any convenient temperature but, as before, is preferably carried out at reflux. If desired, the organic solvent system used in the first and second phases of the extraction process can be different.

The solvent insoluble fraction obtained as described above can be readily separated from the organic solvent system by techniques such as sedimentation, centrifugation, filtration and the like. In accordance with the present invention, the solvent insoluble fraction of the pitch prepared as described about is heat treated for a short period of time in order to reduce volatiles, increase aromaticity and increase the liquid crystal fraction in the precursor. The heat treatment step is carried out under a reduced pressure of about 1 to 600 mm of mercury, preferably about 100–250 mm of mercury in an inert atmosphere such as nitrogen, for example, at temperatures in the range of about 150°–380° C., preferably about 200°–380° C. The reduced pressure heat treatment step is generally effected for a period of time which can range from about 1 to 120 minutes, preferably about 5 to 25 minutes.

The resulting reduced pressure, heat treated precursor can be spun into carbon fiber in accordance with conventional practice. For example, the precursor can be spun using an extruder and spinnerette having, e.g., 200 holes or more. The green fiber is then oxidized and carbonized at high temperature to produce a carbon fiber which will exhibit satifactory tensile strength.

In order to further illustrate the process of this invention, reference can be had to the following examples which are illustrative only and are not meant to limit the scope of the invention.

EXAMPLES 1, 2, 3 AND 4

Production of Vacuum Distiled Petroleum Pitch

A commercial petroleum pitch (Ashland 240) or a pitch derived from cat cracker bottom (cf Table I) was introduced into a reactor which was electrically heated and equipped with a mechanical agitator, nitrogen injection system and distillate recovery system. The pitch or cat cracker bottom was melted by heating to 250° C. under nitrogen, and agitation was commenced when the pitch or bottom had melted. The pressure was reduced in the reactor to about 14 mm Hg absolute. Heating was continued under the reduced pressure and the agitation was continued. When a desired amount of the oil was distilled, the remaining stripped pitch was cooled to about 300° C., discharged and ground. The characteristics of the resulting vacuum distilled petroleum pitches are shown in Table II:

TABLE II

| Example | Feed | % Oil Removed* | Pyridine Insolubles Reflux (%) | Toluene Insolubles Reflux (%) | Quinoline Insolubles (%) | Melting Point (°C.) |
|---|---|---|---|---|---|---|
| 1 | Ashland Pitch 240 | 25 (64) | 3.5 | 13.9 | 0.00 | 222 |
| 2 | Ashland Pitch 240 | 35 (90) | 3.5 | 17.7 | 0.00 | 211 |
| 3 | CCB (I) | 31 (100) | 3.2 | 14.0 | 0.100 | — |
| 4 | CCB (II) | 37 (142) | 14.2 | 37.0 | 2.8 | 202 |

*Base of total weight of pitch treated (% based on amount of distillable oil in parenthesis)

EXAMPLES 5 THROUGH 9

Precursor Preparation by Extraction of Vacuum-Stripped Petroleum Pitches

Ground vacuum-stripped petroleum pitches were mixed with an equal weight of toluene (i.e. a 1:1 pitch to solvent ratio) and a small amount of a filter aid (Celite) and introduced into a reactor equipped with an electrical heating and agitation system. The mixtures were heated at reflux for 1 hour under nitrogen and then filtered at 90° to 100° C. through a sparkler filter system heated prior to filtration to about 90° C. The filtrates, which contain the desired pitch fraction, was pumped into a second vessel and mixed with excess toluene (increasing the pitch: toluene ratio to 1:8) to reject the desired pitch fraction from the solution. The mixtures were refluxed for 1 hour and allowed to cool to room temperature (4–5 hours). The precipitated pitch fractions were then separated using a centrifuge, washed with toluene and finally with n-heptane. The wet cake was dried in a rotary vacuum drier and stored under nitrogen. The resulting precursor characteristics are set forth in Table III below:

TABLE III

| Example | Feed (Pitch of Example 8) | Precursor Yield (%) | Tg (°C.) | n-Heptane Insoluble (%) | Pyridine Insolubles (Reflux %) | Toluene Insolubles (Reflux %) | Ash (%) | Viscosity @ 375–@ 365 | | Volatiles @ 370° C. (%) | Aromatic Carbon Atom (%) |
|---|---|---|---|---|---|---|---|---|---|---|---|
| 5 | 1 | 11.4 | 265 | 99.9 | 32.5 | 76.4 | 0.088 | — | — | 0.9 | — |
| 6 | 1 | 17.0 | 252 | 100.0 | 32.5 | 77.1 | 0.085 | 444 | 1131 | 0.8 | — |
| 7 | 1 | 17.8 | 243 | 99.7 | 29.5 | 77.4 | 0.005 | — | — | 0.8 | — |
| 8 | 1 | 22.8 | 251 | 99.3 | 27.5 | 72.2 | 0.005 | — | — | 0.8 | 87 |
| 9 | 4 | 17.0 | — | — | 28.0 | 74.0 | 0.005 | — | — | — | — |

EXAMPLE 10

Reduced Pressure Heat Treatment of Precursor

The precursor materials obtained in Examples 5 through 9 are introduced into a stainless steel reactor and heated to 360° C. using a bath of a molten heat-transfer salt. The pressure in the reactor is reduced to about 250 mm mercury. The reactor is equipped with a mechanical agitator and agitation of the molten pitch is started as soon as possible to allow good heat transfer to the mass of the pitch. The molten pitch is allowed to react for 20 minutes and then cooled to room temperature under reduced temperature.

EXAMPLES 11–23

Preparation of Spinnable Pitch

A pitch fraction obtained by extracting a heat treated petroleum pitch with a toluene/heptane mixture according to U.S. Pat. No. 4,271,006 was thermally treated for about 15 minutes at either 250°, 360°, 380° or 400° C. under a reduced pressure of either 50, 100, 250 or 350 mm Hg. The characteristics of the pitch before and after the reduced pressure heat-soaking is set forth in the following Table:

| | | Example | | | | | | | | | | | | |
|---|---|---|---|---|---|---|---|---|---|---|---|---|---|---|
| | | 11 | 12 | 13 | 14 | 15 | 16 | 17 | 18 | 19 | 20 | 21 | 22 | 23 |
| Temperature (°C.) | | 400 | | | | 380 | | | | 360 | | | | 250 |
| Pressure (mm Hg) | Feed | 50 | 100 | 250 | 350 | 50 | 100 | 250 | 350 | 50 | 100 | 250 | 350 | 50 |
| Toluene Insolubles (%) | 80.0 | 94.0 | 93.7 | 89.9 | 89.7 | 93.4 | 88.4 | 87.9 | 86.0 | 89.4 | 85.0 | 85.4 | 87.9 | 90.6 |
| Pyridine Insolubles (%) | 43.3 | 73.5 | 69.1 | 58.6 | 58.5 | 64.5 | 62.5 | 49.8 | 49.0 | 48.5 | 45.2 | 45.0 | 46.4 | 49.1 |
| Quinoline Insolubles (%) | 0.3 | 34.4 | 19.6 | 1.0 | 0.6 | 8.9, 10.5 | 3.9, 4.7 | 0.2, 0.3 | 0.6, 0.7 | 1.0 | 0.2, 0.3 | 0.3, 0.6 | 0.8, 1.0 | 0.8 |
| Glass Transition Temperature (Tg) | 250 | — | 258 | 254 | 247 | 262 | 261 | 255 | 250 | — | 263 | 256 | 251 | — |
| Tg | — | — | +8 | +4 | −3 | +12 | +11 | 0 | +5 | — | +13 | +6 | +1 | — |
| Viscosity (poise) | | | | | | | | | | | | | | |
| @ 360° C. | — | — | — | 2785 | 2785 | — | — | 2698 | 2698 | — | — | 2785 | 2959 | — |
| @ 370° C. | — | — | — | 870 | 1088 | — | — | 914 | 870 | — | — | 914 | 1523 | — |
| @ 375° C. | — | — | 5918 | 479 | 653 | — | — | 522 | 479 | — | — | 487 | 836 | — |
| Volatiles (Wt. % loss) @ 370° C. (%) | 0.9 | 0.1 | 0.3 | 0.2 | 0.3 | 0.2 | 0.3 | 0.2 | 0.4 | 0.2 | 0.3 | 0.3 | 0.3 | — |
| Carbon (%) | — | — | 92.09 | — | 94.40 | 93.80 | 93.04 | 93.29 | 94.05 | — | 91.07 | — | — | — |
| Hydrogen (%) | — | — | 4.22 | — | 4.33 | 4.33 | 4.30 | 4.32 | 4.33 | — | 4.11 | — | — | — |
| C/H Atomic Ratio | 1.70 | — | 1.81 | — | 1.80 | 1.80 | 1.80 | 1.80 | 1.81 | — | 1.84 | — | — | — |

Various changes and modifications can be made in the process and products of this invention without departing from the spirit and scope thereof. The various embodiments which have been described herein were for the purpose of further illustrating the invention but were not intended to limit it.

What is claimed is:

1. A process for preparing a pitch product suitable for spinning into carbon fibers comprising the following steps: (a) subjecting a heat soaked, distillable oil removed carbonaceous residue of petroleum origin to a two-stage solvent separation treatment with an organic solvent having a solubility parameter of about 8–9.5, the first stage being the solubilization of a fraction of said carbonaceous residue in said organic solvent and separation of insolubles therefrom, the second stage being the separation of a solvent insoluble fraction from the resulting solvent phase; and (b) thereafter devolatilizing the separated solvent insoluble fraction at a temperature of about 150°–380° C. and under a reduced pressure of about 1–6000 mm Hg to reduce volatiles and to obtain said pitch product.

2. The process of claim 1 in which said devolatilization temperature is about 200°–380° C. and said pressure is about 100–250 mm Hg.

3. The process of claim 2 in which the devolatilization of the extracted solvent insoluble fraction is effected for about 1–120 minutes.

4. The process of claim 3 in which the devolatilization is from about 5 to 25 minutes.

5. The process of claim 1 in which the devolatilization of the extracted solvent insoluble fraction is effected for about 1–120 minutes.

6. The process of claim 5 in which the devolatilization is from about 5 to 25 minutes.

7. The process of claim 1 in which the residue: solvent system ratio in the first stage is about 0.5:1 to 1:0.5.

8. The process of claim 7 in which the residue:solvent system ratio in the second stage is about 1:2 to 1:16.

9. The process of claim 1 in which the solvent parameter is about 8.7 to 9.2.

10. The process of claim 9 in which said organic solvent system comprises toluene.

11. The process of claim 1 in which said residue subjected to extraction has at least 40% of its distillable oil removed therefrom.

12. The process of claim 11 in which said solvent extraction is effected in two stages, the first stage being the solubilization of a fraction of said residue in said solvent at a residue:solvent system ratio of about 0.5:1 to 1:0.5, and separation of insolubles therefrom and the second stage being the precipitation of said fraction from said solvent at a residue:solvent system ratio of about 1:2 to 1:16.

* * * * *